US009444142B2

(12) United States Patent
Lee et al.

(10) Patent No.: US 9,444,142 B2
(45) Date of Patent: Sep. 13, 2016

(54) DUAL BAND ANTENNA AND WIRELESS COMMUNICATION DEVICE EMPLOYING SAME

(71) Applicant: Chiun Mai Communication Systems, Inc., New Taipei (TW)

(72) Inventors: Yi-Chieh Lee, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 184 days.

(21) Appl. No.: 14/014,574

(22) Filed: Aug. 30, 2013

(65) Prior Publication Data

US 2014/0111382 A1 Apr. 24, 2014

(30) Foreign Application Priority Data

Oct. 19, 2012 (TW) ..... 101138831 A

(51) Int. Cl.
*H01Q 5/357* (2015.01)

(52) U.S. Cl.
CPC ..... *H01Q 5/357* (2015.01)

(58) Field of Classification Search
CPC ..... H01Q 5/357; H01Q 5/0093
See application file for complete search history.

(56) References Cited

U.S. PATENT DOCUMENTS 7,315,289 B2 * 1/2008 Puente Baliarda et al. .. 343/817
2011/0050528 A1 * 3/2011 Montgomery ..... 343/795

OTHER PUBLICATIONS

K.L. Wong, W.J. Wei and L.C. Chou, "WWAN/LTE printed loop antenna for tablet computer and its body SAR analysis," Microwave Opt. Technol. Lett., vol. 53, pp. 2912-2919, Dec. 2011.

* cited by examiner

*Primary Examiner* — Michael C Wimer
*Assistant Examiner* — Noel Maldonado
(74) *Attorney, Agent, or Firm* — Zhigang Ma

(57) ABSTRACT

A dual band antenna includes a first radiating portion, a second radiating portion, and a resonating portion. The first radiating portion includes a first feeding arm that feeds first signals at a first frequency band. The second radiating portion is positioned spaced apart from the first radiating portion. The second radiating portion includes a second feeding arm that feeds second signals at a second frequency band. The resonating portion is connected between the first radiating portion and the second radiating portion. The resonating portion resonates with the first and second radiating portions to generate two different frequency bands, so that the dual band antenna receives and sends wireless signals at the first and second frequency bands.

8 Claims, 4 Drawing Sheets

DUAL BAND ANTENNA AND WIRELESS COMMUNICATION DEVICE EMPLOYING SAME

BACKGROUND

1. Technical Field

The exemplary disclosure generally relates to antennas, and particularly to a dual band antenna and a wireless communication device employing the dual band antenna.

2. Description of Related Art

Bluetooth (BT) antennas and global positioning system (GPS) antennas are designed separately. In order to miniaturize portable communication devices, when the BT antenna and the GPS antenna are assembled into a wireless communication device (such as a mobile phone), they are positioned adjacent to each other or assembled together to occupy a common dielectric clearance region. However, the frequency bands of the BT antenna and the GPS antenna often interfere with each other. If the BT antenna and the GPS antenna are positioned further apart from each other, an additional dielectric clearance region will be needed, thereby increasing a size of the wireless communication device.

Therefore, there is room for improvement within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

DETAILED DESCRIPTION

Figure 1:
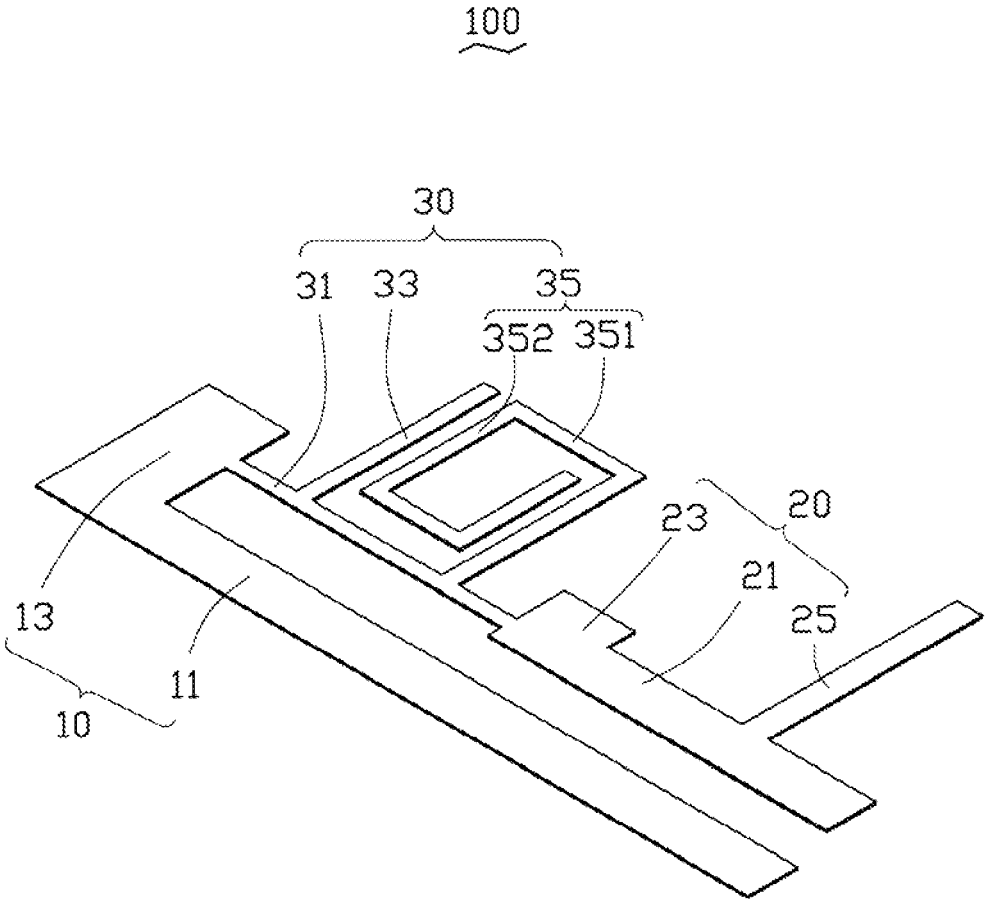
FIG. 1 is a schematic view of a dual band antenna, according to an exemplary embodiment.

FIG. 1 is a schematic view of a dual band antenna 100, according to an exemplary embodiment. The dual band antenna 100 is used in a wireless communication device, such as a mobile phone or a tablet computer, for example. The dual band antenna 100 includes a first radiating portion 10, a second radiating portion 20, and a resonating portion 30, all of which are positioned in the same plane. The first radiating portion 10 is positioned spaced apart from the second radiating portion 20, and the resonating portion 30 is connected between the first radiating portion 10 and the second radiating portion 20.

In the exemplary embodiment, the first radiating portion 10 is a monopole antenna, the second radiating portion 20 is a planar inverted-F antenna (PIFA), and the resonating portion 30 is a planar micro-strip antenna.

The first radiating portion 10 is a substantially L-shaped sheet, and includes a first radiating arm 11 and a first feeding arm 13 perpendicularly extending from one end of the first radiating arm 11. A distal end of the first feeding arm 13 is electronically connected to a printed circuit board, so as to serve as a feed point to feed first signals at a first frequency band, such as 1575 MHz.

The second radiating portion 20 is a substantially F-shaped sheet, and is positioned spaced apart from the first radiating portion 10. The second radiating portion 20 includes a second radiating arm 21, a second feeding arm 23, and a grounding arm 25. The second feeding arm 23 and the grounding arm 25 extend substantially perpendicularly from one side of the second radiating arm 21, and are spaced from each other. The second feeding arm 23 is connected to one end of the second radiating arm 21, and the grounding arm 25 is connected to a middle portion of the second radiating arm 21. The second radiating arm 21 is parallel to the first radiating arm 11, and the second feeding arm 23 is parallel to the first feeding arm 13. A distal end of the second feeding arm 23 is electronically connected to the printed circuit board, so as to serve as a second feed point to feed second signals at a second frequency band, such as 2450 MHz. A distal end of the grounding arm 25 is grounded via the printed circuit board.

The resonating portion 30 includes a connecting arm 31, a first extending arm 33, and a second extending arm 35. The connecting arm 31 is a substantially longitudinal planar sheet. One end of the connecting arm 31 is perpendicularly connected to the first feeding arm 13, while another end of the connecting arm 31 is perpendicularly connected to the second feeding arm 23. The first and second extending arms 33 and 35 are spaced from each other and extend from one side of the connecting arm 31 away from the first radiating arm 11. The first radiating arm 33 is a substantially longitudinal planar sheet, and is positioned between the second extending arm 35 and the first feeding arm 13. The second extending arm 35 is positioned between the first extending arm 33 and the second feeding arm 23. The second extending arm 35 is spiral-shaped. In particular, the second extending arm 35 includes an L-shaped sheet 351 and a U-shaped sheet 352 connected to the L-shaped sheet 351. The L-shaped sheet 351 extends substantially perpendicularly from one side of the connecting arm 31, and then extends perpendicularly toward the first extending arm 33 to be parallel to the connecting arm 31. The U-shaped sheet 352 extends substantially perpendicularly from an end of the L-shaped sheet 351 to be parallel to the first extending arm 33, and is then perpendicularly formed to be parallel to the connecting arm 31, and finally extends perpendicularly along a direction away from the connecting arm 31.

Figure 2:
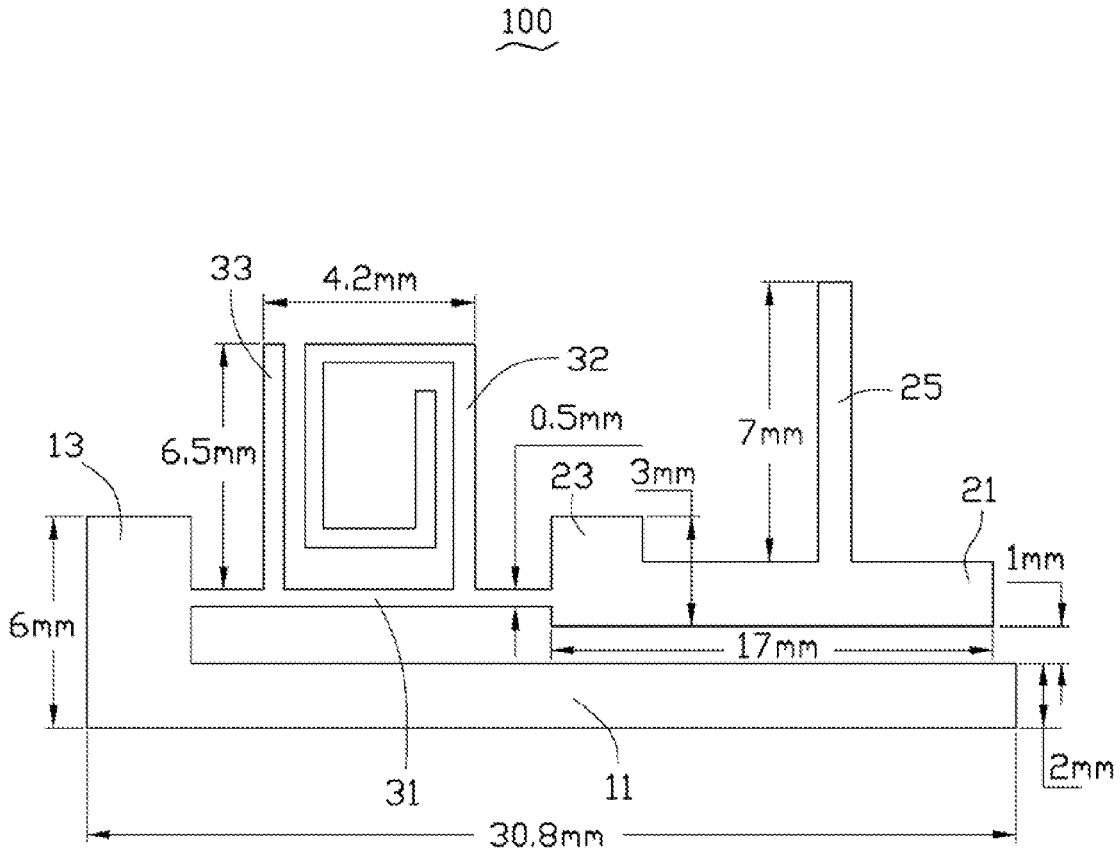
FIG. 2 is a plan view of the dual band antenna of FIG. 1.

FIG. 2 is a plan view of the dual band antenna 100 shown in FIG. 1. In the exemplary embodiment, widths of the connecting arm 31, the first extending arm 33, and the second extending arm 35 are about 0.5 mm. A length of the first extending arm 33 is about 6.5 mm. A distance between an edge of the first extending arm 33 opposite to the second extending arm 35 and an edge of the second extending arm 35 opposite to the first extending arm 33 is about 4.2 mm. Widths of the first and second radiating arms 11 and 21 are about 2 mm. A distance between the first and second radiating arms 11 and 21 is about 1 mm. A length of the first radiating arm 11 is about 30.8 mm. A length of the first feeding arm 13 is about 6 mm. A length of the second radiating arm 21 is about 17 mm. A length of the second feeding arm 23 is about 3 mm. A length of the grounding arm 25 is about 7 mm.

In use, the dual band antenna 100 is excited by the first feed signals and the second feed signals respectively fed to the first feeding arm 13 and the second feeding arm 23. The first radiating portion 10, the connecting arm 31, and the second radiating portion 20 cooperate to form a first current path, thereby generating a first frequency band at about 1575 MHz. The resonating portion 30 and the second radiating portion 20 cooperate to form a second current path, thereby generating a second frequency band at about 2450 MHz. The first frequency band is generated by resonation between the resonating portion 30 and the first radiating portion 10, and the second frequency band is generated by radiation between the resonating portion 30 and the second radiating portion 20. Therefore, the transmission frequencies of the first and second radiating portions 10 and 20 are prevented from interfering with each other.

Figure 3:
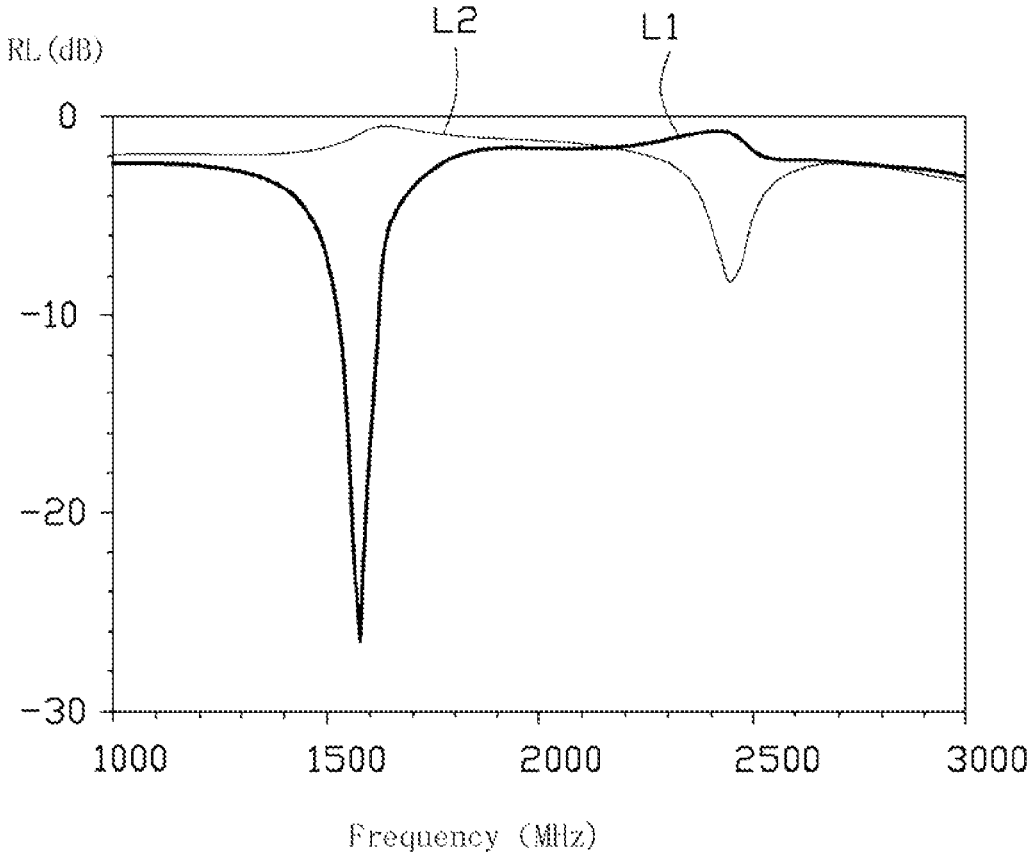
FIG. 3 is an RL (return loss) diagram of the dual band antenna of FIG. 1.
Figure 4:
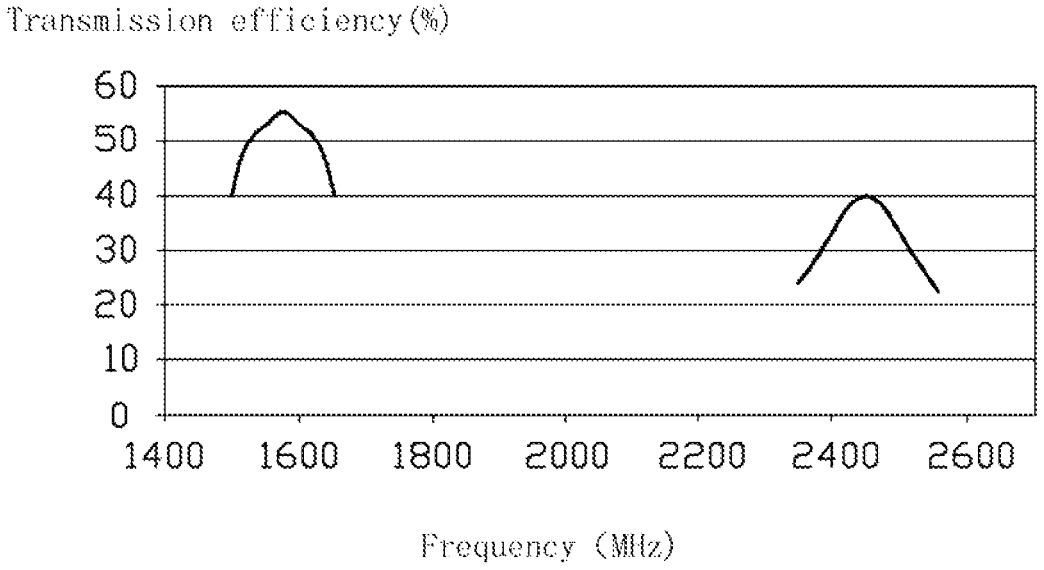
FIG. 4 is a transmission efficiency measurement of the dual band antenna of FIG. 1.

FIG. 3 is an RL diagram of the dual band antenna 100 shown in FIG. 1. FIG. 4 is a transmission efficiency measurement of the dual band antenna 100 shown in FIG. 1. A curve L1 in FIG. 3 is the RL of the dual band measured at the first feed point of the first feeding arm 13, and a curve L2 in FIG. 3 is the RL of the dual band measured at the second feed point of the second feeding arm 23. As shown in FIG. 3 and FIG. 4, the dual band antenna 100 receives/sends wireless signals at two frequency bands, and achieves high transmission efficiency at each frequency band. In particular, the RL of the dual band antenna 100 is less than −6 dB when the dual band antenna 100 receives/sends wireless signals at frequencies of about 1575 MHz and about 2450 MHz. Accordingly, the dual band antenna 100 can be used in common wireless communication systems, such as Bluetooth and GPS, with exceptional communication quality.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A dual band antenna, comprising:

a first radiating portion comprising a first feeding arm that feeds first signals at a first frequency band;

a second radiating portion positioned spaced apart from the first radiating portion, the second radiating portion comprising a second feeding arm that feeds second signals at a second frequency band;

a resonating portion connected between the first radiating portion and the second radiating portion, the resonating portion resonating with the first and second radiating portions to generate two different frequency bands, such that the dual band antenna can receive and send wireless signals at the first and second frequency bands;

wherein the first radiating portion is a substantially inverted-L shape sheet, and further comprises a first radiating arm perpendicularly extending from one end of the first feeding arm; a distal end of the first feeding arm is electronically connected to a printed circuit board to feed the first signal;

wherein the second radiation portion further comprises a second radiating arm extending substantially perpendicularly from the second feeding arm, the second radiating arm is parallel to the first radiating arm, the second feeding arm is parallel to the second feeding arm; and wherein the resonating portion comprises a connecting arm, a first extending arm, and a second extending arm; one end of the connecting arm is perpendicularly connected to the first feeding arm, the other end of the connecting arm is connected to a junction between the second feeding arm and the second radiating arm, and is perpendicular to the second feeding arm; the first and second extending arms are spaced extended from one side of the connecting arm opposite to the first radiating arm; the second extending arm comprises a substantially L-shaped sheet and a substantially U-shaped sheet connected to the L-shaped sheet, the L-shaped sheet extends substantially perpendicularly from one side of the connecting arm, and then perpendicularly extends toward the first extending arm to be parallel to the connecting arm; the U-shaped sheet extends substantially perpendicularly from an end of the L-shaped sheet to be parallel to the first extending arm, and is then perpendicularly formed to be parallel to the connecting arm, and finally perpendicularly extends along a direction away from the connecting arm.

2. The dual band antenna of claim 1, wherein the first radiating portion is a monopole antenna, the second radiating portion is a substantially planar inverted-F antenna (PIFA), the resonating portion is a substantially planar micro-strip antenna.

3. The dual band antenna of claim 1, wherein the first radiating portion, the second radiating portion, and the resonating portion are in the same plane.

4. The dual band antenna of claim 1, wherein the second radiating portion further comprises a grounding arm extending substantially perpendicularly from the second radiating arm, the grounding arm is grounded.

5. A wireless communication device, comprising:

a dual band antenna comprising:

a first radiating portion comprising a first feeding arm that feeds first signals at a first frequency band;

a second radiating portion positioned spaced apart from the first radiating portion, the second radiating portion comprising a second feeding arm that feeds second signals at a second frequency band;

a resonating portion connected between the first radiating portion and the second radiating portion, the resonating portion resonating with the first and second radiating portions to generate two different frequency bands, such that the dual band antenna can receive and send wireless signals at the first and second frequency bands;

wherein the first radiating portion is a substantially inverted-L shape sheet, and further comprises a first radiating arm perpendicularly extending from one end of the first feeding arm; a distal end of the first feeding arm is electronically connected to a printed circuit board to feed the first signal;

wherein the second radiation portion further comprises a second radiating arm extending substantially perpendicularly from the second feeding arm, the second radiating arm is parallel to the first radiating arm, the second feeding arm is parallel to the second feeding arm; and wherein the resonating portion comprises a connecting arm, a first extending arm, and a second extending arm; one end of the connecting arm is perpendicularly connected to the first feeding arm, the other end of the connecting arm is connected to a junction between the second feeding arm and the second radiating arm, and is perpendicular to the second feeding arm; the first and second extending arms are spaced extended from one side of the connecting arm opposite to the first radiating arm; the second extending arm comprises a substantially L-shaped sheet and a substantially U-shaped sheet connected to the L-shaped sheet, the L-shaped sheet extends substantially perpendicularly from one side of the connecting arm, and then perpendicularly extends toward the first extending arm to be parallel to the connecting arm; the U-shaped sheet extends substantially perpendicularly from an end of the L-shaped sheet to be parallel to the first extending arm, and is then perpendicularly formed to be parallel to the connecting arm, and finally perpendicularly extends along a direction away from the connecting arm.

6. The dual band antenna of claim 5, wherein the first radiating portion is a monopole antenna, the second radiating portion is a substantially planar inverted-F antenna (PIFA), the resonating portion is a substantially planar micro-strip antenna.

7. The dual band antenna of claim 5, wherein the first radiating portion, the second radiating portion, and the resonating portion are in the same plane.

8. The dual band antenna of claim 5, wherein the second radiating portion further comprises a grounding arm extending substantially perpendicularly from the second radiating arm, the grounding arm is grounded.

* * * * *